US007578289B2

(12) United States Patent
Norkus

(10) Patent No.: US 7,578,289 B2
(45) Date of Patent: Aug. 25, 2009

(54) COMPOUND ARCHERY BOW WITH EXTENDED INVERTED STROKE

(76) Inventor: Gregory Norkus, 12830 S. Russian Creek Rd., Kodiak, AK (US) 99615

( * ) Notice: Subject to any disclaimer, the term of this patent is extended or adjusted under 35 U.S.C. 154(b) by 358 days.

(21) Appl. No.: 11/467,965

(22) Filed: Aug. 29, 2006

(65) Prior Publication Data

US 2007/0044782 A1 Mar. 1, 2007

Related U.S. Application Data

(60) Provisional application No. 60/713,186, filed on Aug. 30, 2005.

(51) Int. Cl.
*F41B 5/10* (2006.01)

(52) U.S. Cl. ..... 124/25.6; 124/25; 124/35.2; 124/44.5

(58) Field of Classification Search ..... 124/23.1, 124/24.1, 25, 25.6, 86, 88, 35.2
See application file for complete search history.

(56) References Cited

U.S. PATENT DOCUMENTS 4,722,317 A * 2/1988 Hartwig ..... 124/25.6
5,146,908 A * 9/1992 Larson ..... 124/88
5,465,705 A * 11/1995 Baeseman ..... 124/88
5,630,405 A * 5/1997 Nizov ..... 124/25
5,671,723 A * 9/1997 Goff et al. ..... 124/35.2
6,679,240 B1 * 1/2004 Hurd ..... 124/24.1
7,328,693 B2 * 2/2008 Kempf ..... 124/25
2006/0081232 A1 * 4/2006 Woodland ..... 124/25.6

* cited by examiner

*Primary Examiner*—John Ricci
(74) *Attorney, Agent, or Firm*—Merchant & Gould LLC

(57) ABSTRACT

An inverted compound archery bow including an extended-capacity cam system having two cams, each cam engaging the bowstring and separate cables extending to limbs of the bow. The bowstring and cables are counter-wound on the cams, producing tension opposite and proportional to the inverse ratio of windings. Drawing the bowstring winds the cables onto the cams, producing limb tension that propels an arrow when the bowstring is released. An arrow rest located between full-draw and rest excursions of the bowstring accommodates the extended draw length of the bow. A bowstring arrestor engages the bowstring at an intermediate-draw position. A slide stabilizes and supports a rear portion of the bow, and a receptacle on the slide engages an adapter for a bowstring release mechanism.

18 Claims, 11 Drawing Sheets

Extended Power-Stroke Inverted Compound Bow

Archery Bow

NOTE: "Nock" refers both to the notch at the rear of an arrow and also to the point on the bowstring where the arrow notch is placed. The nock on the bowstring is typically near its midpoint.

Bow Dimensions

Inverted Bow

Compound Bow

Extended Power-Stroke Inverted Compound Bow

Comparative Power-Stroke

Cam and Pulley System (cables not shown for clarity)

Arrow Rest Rotation

Use of Bowstring Arrestor

Bowstring Arrestor

Slide Rod Mechanism

Slide Rod, Arm, and Receptacle are shown in cross-section

Adapter in Receptacle

Release Mechanism with Adapter

Release Mechanism in Slide receptacle

COMPOUND ARCHERY BOW WITH EXTENDED INVERTED STROKE

CROSS-REFERENCE TO RELATED APPLICATION

This application claims the benefit of provisional application No. 60/713,186 filed Aug. 30, 2005.

FIELD OF THE INVENTION

This invention relates in general to archery bows, and relates in particular to inverted compound archery bows.

BACKGROUND OF THE INVENTION

A conventional archery bow (FIG. 1) converts the mechanical work of drawing the bowstring into potential energy stored in the spring tension of the limbs which is released as the kinetic energy of the arrow. According to the laws of physics the work input, stored potential energy, and released kinetic energy are equivalent except for frictional and dynamic losses.

The energy capacity of the traditional bow, shown in FIGS. 1 and 2, is the product of the draw-weight and power-stroke. The power-stroke is the draw-length minus the brace-height (FIG. 2). In the design of the traditional bow, the brace-height provides clearance for the gripping hand by limiting the forward travel of the bowstring to a distance from the grip. The usable draw-weight is limited by the strength of the archer, the draw-length is limited by the reach of the archer, and the power-stroke is reduced by the brace-height. These three factors are the primary limitations to the energy capacity of the traditional bow.

The inverted bow (FIG. 3) requires less string and limb-tension for a given draw-weight and power-stroke compared to the traditional bow, but stores and releases no more energy. The inverted bow is inherently problematic to grasp and hold due to rotational forces about the grip, lacks practical methods to nock and rest the arrow, and limits the draw-length by the dimensions of the bow. For these reasons, the inverted bow has never come into practical use.

The compound bow (FIG. 4) utilizes an eccentric cam system to modify the draw-force versus draw-length characteristics of the bow, and to provide a substantial reduction of draw-weight at the full-draw position. As in the case of the traditional bow, the power-stroke is reduced by the brace-height and the compound bow is subject to the same factors which limit energy capacity.

SUMMARY OF THE INVENTION

An archery bow according to the present invention overcomes many limitations that have precluded the practical use of the inverted-limb configuration. The present archery bow has the advantages of a compound system and offers a longer power-stroke having the capacity to store and release substantially more energy than possible in the prior state-of-the-art archery bows, which include traditional, inverted, and compound bow designs (FIG. 6). In comparison, an archery bow according to the present invention has nearly twice the power-stroke and energy capacity of such earlier designs.

Stated in somewhat greater detail, features of a practicable extended power-stroke inverted compound archery bow according to the present invention include an extended-capacity cam system having two cams, each of which engages the bowstring and separate cables extending to limbs of the bow. Drawing the bowstring causes the cables to wind onto the cams, producing limb tension that acts to propel an arrow when the bowstring is released.

Other features of an archery bow according to the present invention include an arrow rest placed between excursions of the bowstring between full-drawn and rest, so as to accommodate the extended draw length of the bow. The arrow rest drops away from the path of the bowstring and the arrow when the arrow is released, to avoid interference between the arrow rest and the path of the bowstring. A bowstring arrestor mechanism enables placement of the arrow onto the nock and an arrow rest by first placing the bow into a partially-drawn condition, and preventing release of the bowstring from the partially-drawn condition. Embodiments of the bow also include a support that stabilizes the rear portion of the bow by engaging and supporting an arrow release mechanism that draws the bowstring into the fully-drawn condition, and a slide that prevents an unwanted release of the bowstring as the arrow release mechanism draws the bowstring to the full-draw position.

Other aspects and features of the present invention will become apparent from the following description of a preferred embodiment.

DETAILED DESCRIPTION OF PREFERRED EMBODIMENT

Figure 1:
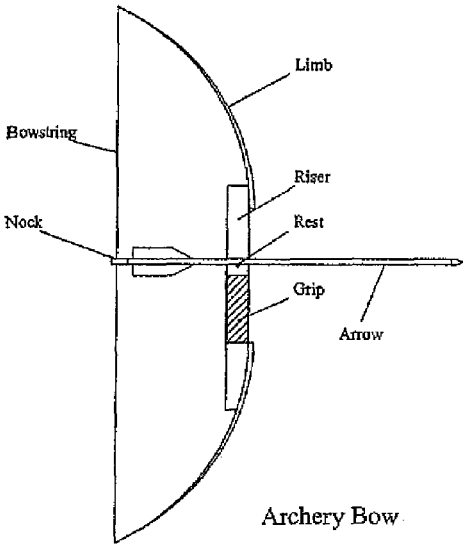
Figure 1 Prior Art
FIG. 1 shows a traditional archery bow.
Figure 2:
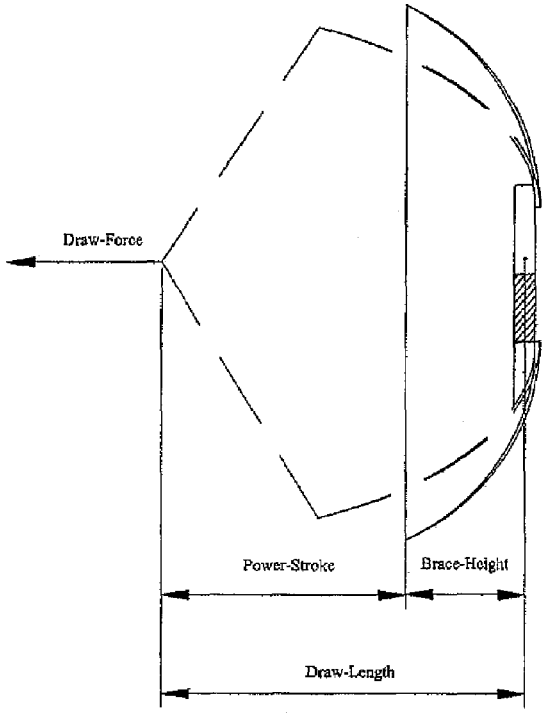
Figure 2 Prior Art
FIG. 2 illustrates certain dimensions relating to the bow shown in FIG. 1.
Figure 3:
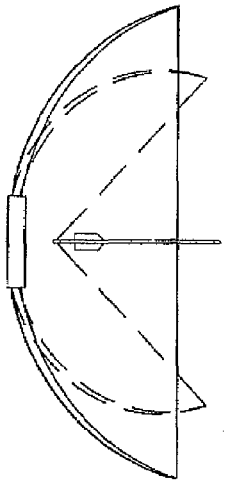
Figure 3 Prior Art
FIG. 3 shows a conventional inverted archery bow.
Figure 4:
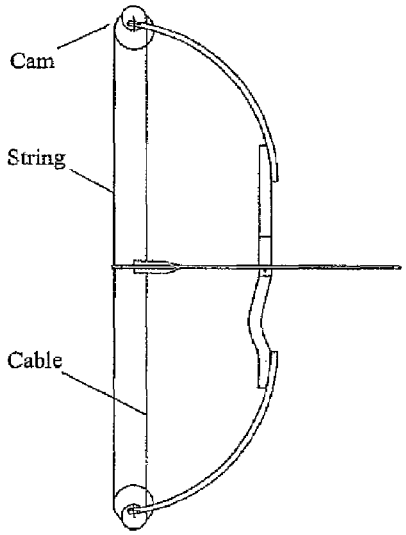
Figure 4 Prior Art
FIG. 4 shows a conventional compound archery bow.
Figure 5:
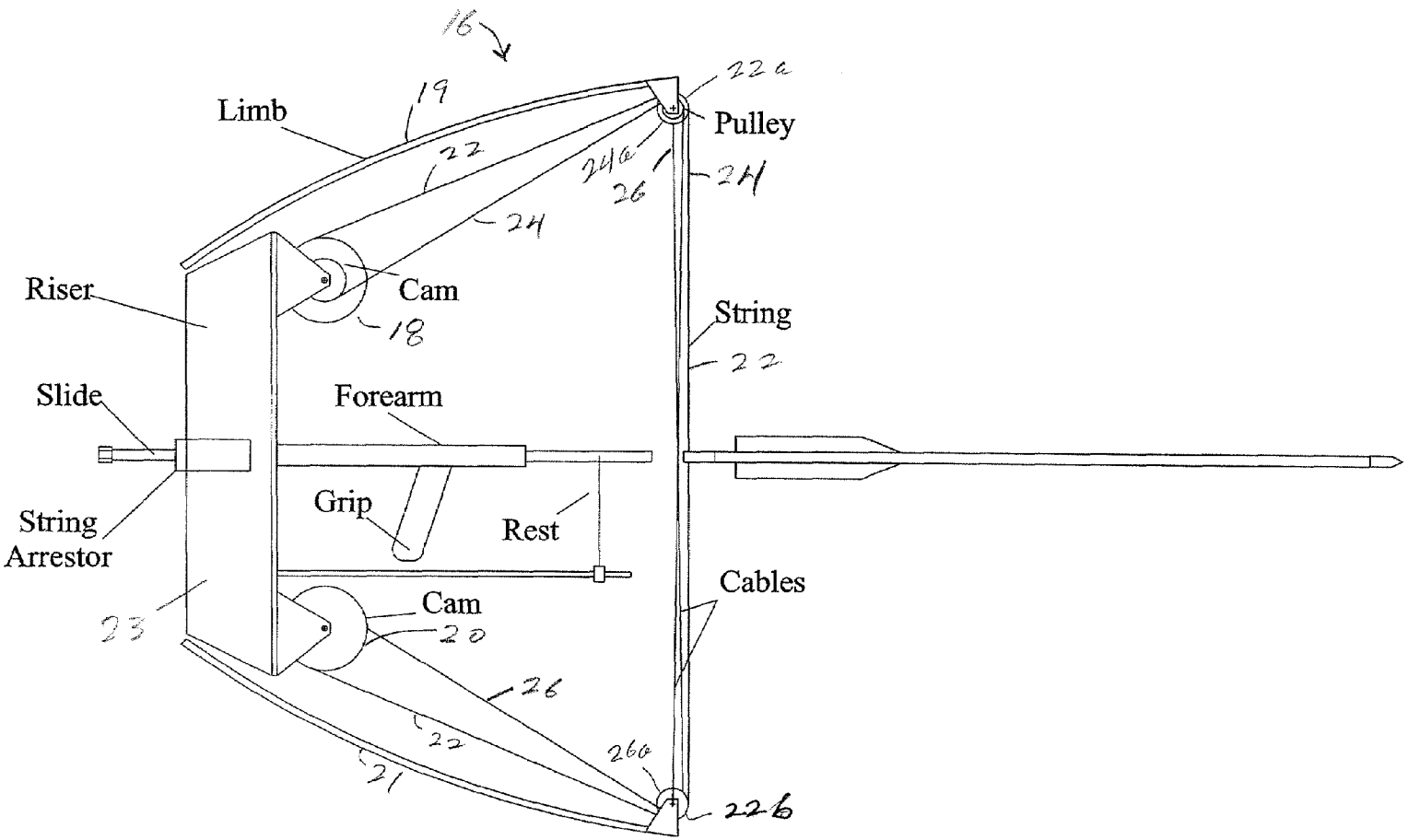
FIG. 5 shows an archery bow according to a disclosed embodiment of the present invention.
Figure 6:
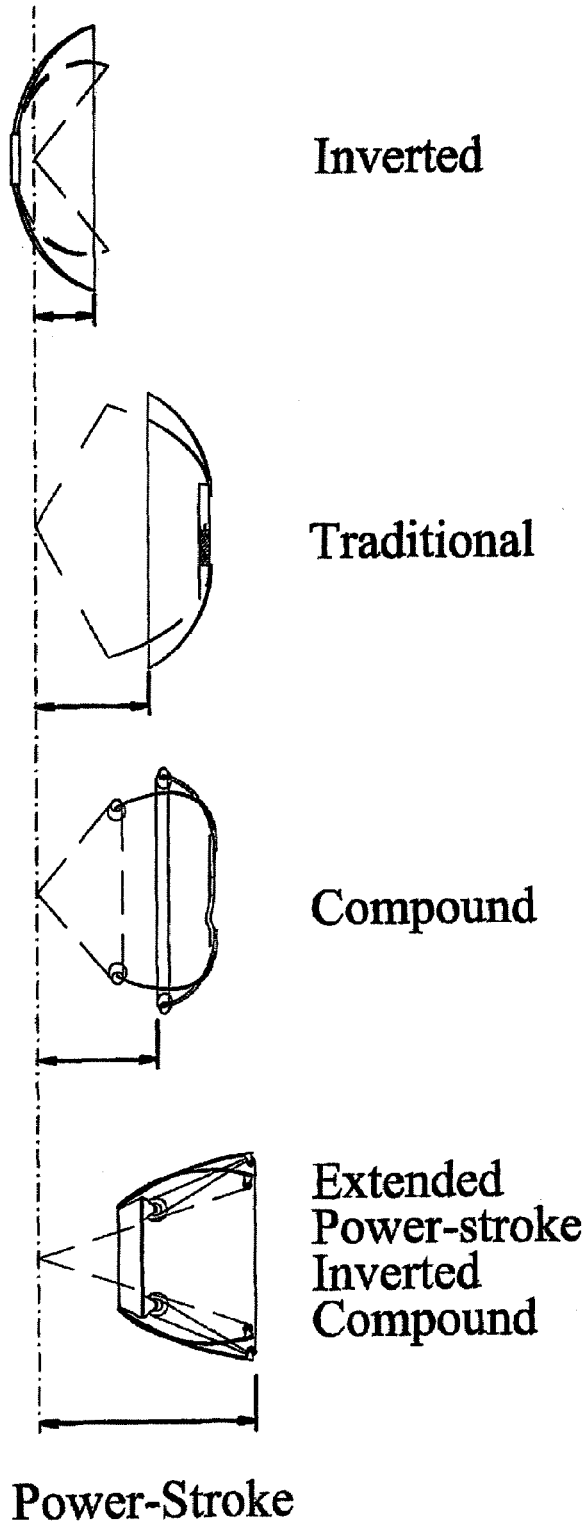
FIG. 6 illustrates comparative power strokes and energy capacity of an archery bow according to the present invention, relative to archery bows according to the inverted, traditional, and compound designs.
Figure 7:
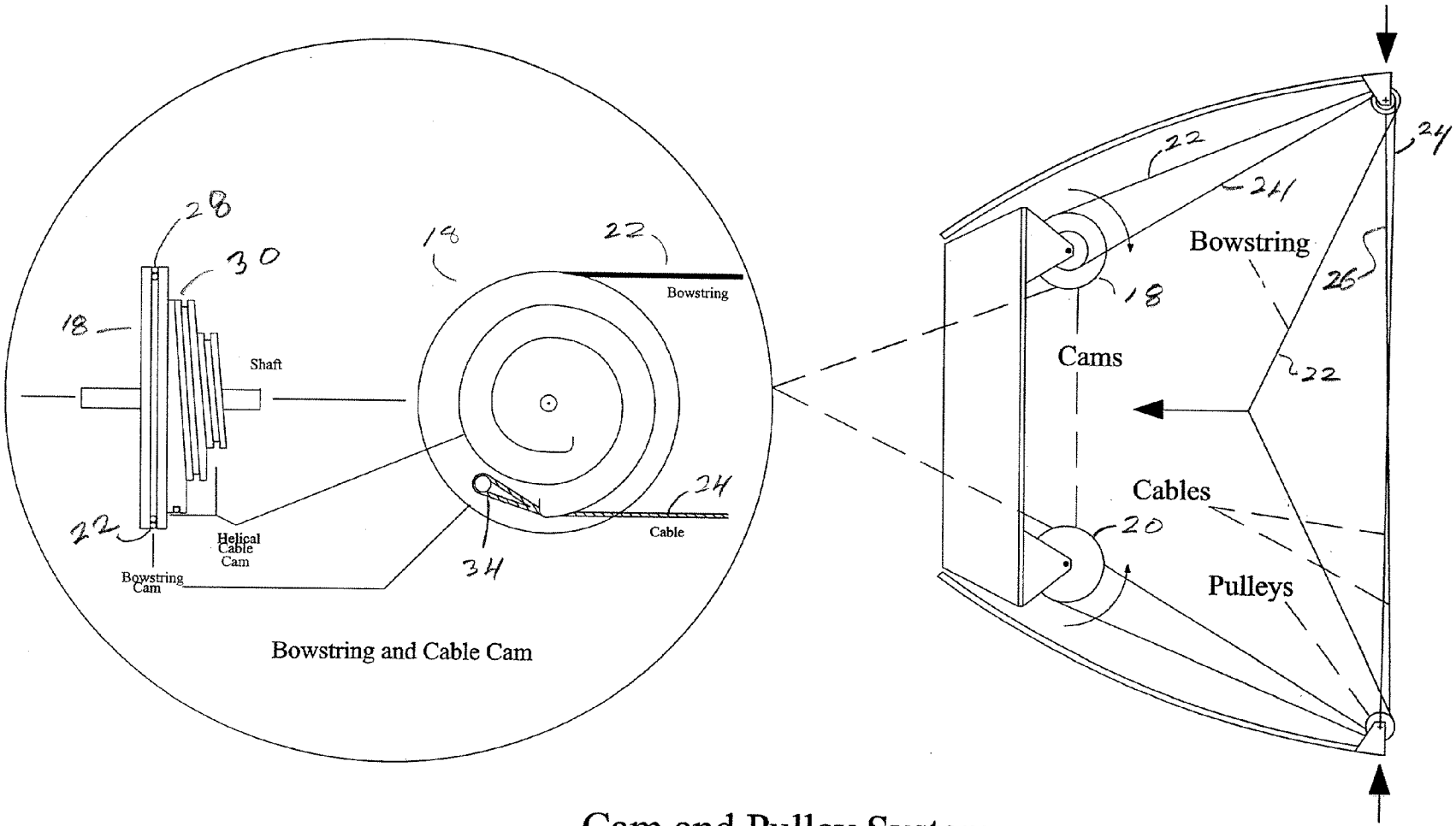
FIG. 7 shows details of the cam and pulley system in the disclosed embodiment of FIG. 1.

An archery bow according to the disclosed embodiment is shown generally at 16 in at FIGS. 5 and 7, and includes two counter-rotating cams 18 and 20, a bowstring 22, two cables 24 and 26, and four pulleys 22*a*, 24*a* and 22*b*, 26*a* at outer ends of the limbs 19 and 21 extending outwardly and forwardly from the riser 23. A forearm extends forwardly from the riser and supports a grip for the hand of an archer The cams 18 and 20 of the bow each contain a groove 28 to receive the bowstring 22 and a groove 30 to receive the respective cable 24 or 26. The cams 18 and 20 rotate on axes supported on the riser 23 and revolve through approximately 720 degrees of rotation at full-draw. Therefore, the bowstring 22 wraps around each cam twice in the bowstring groove 28. The grooves 30 for the cables 24 and 26 are helical in shape and also have the capacity for two full wraps. At any point of rotation the string and cable tension are opposite and proportional to the inverse ratio of the radii from their grooves to the center of the cam. In this fashion, the draw-force can be modified along the draw-length by the relative shape of the string and cable cams. In the disclosed embodiment, the bowstring cams defined by the bowstring grooves 28 are shown to be circular, but in alternative embodiments those grooves may be helical if necessary to achieve a particular draw-force versus draw-length characteristic. Also, in this disclosed embodiment the cam rotation is approximately 720 degrees at full-draw, but other embodiments may employ more or fewer degrees of rotation.

Each bowstring groove 28 in the disclosed embodiment, as best seen in FIG. 7, is deep enough to accept more than one layer of the bowstring as the cams rotate for more than one revolution, an arrangement that reduces the axial size and the weight of the cams 18 and 20 vs. cams on which multiple turns of the bowstring are wound side by side. It should be understood that an alternative arrangement of the cable grooves 30 might employ the same arrangement of depth sufficient to accept more than one layer of the respective cables.

The bowstring 22 and cables 24, 26 are attached to the cams and wound in opposite directions so that tension on the bowstring and cable is in opposition. One end of each cable, e.g., end 34 of cable 24 as seen in FIG. 7, is attached to one of the cams, e.g., cam 18. The cable 24 then passes over the pulley 24*a* mounted on a shaft at the tip of the corresponding limb 19 and is attached to the tip of the opposite limb 21. One end of the bowstring 22 is attached within its groove in the cam 18 and passes over the pulley 22*a* on the corresponding limb 19. The bowstring 22 then passes over the pulley 22*b* on the opposite limb 21 and is attached within the bowstring groove in the opposite cam 20.

As the bowstring is drawn it unwinds from the cams and is opposed by the winding of the cables onto the cams. The winding of the cables onto the cams compresses the limbs and results in higher limb-tension. When the bowstring is released, the process is reversed and the arrow is propelled forward by the limb-tension acting through the cam and pulley system.

Figure 8:
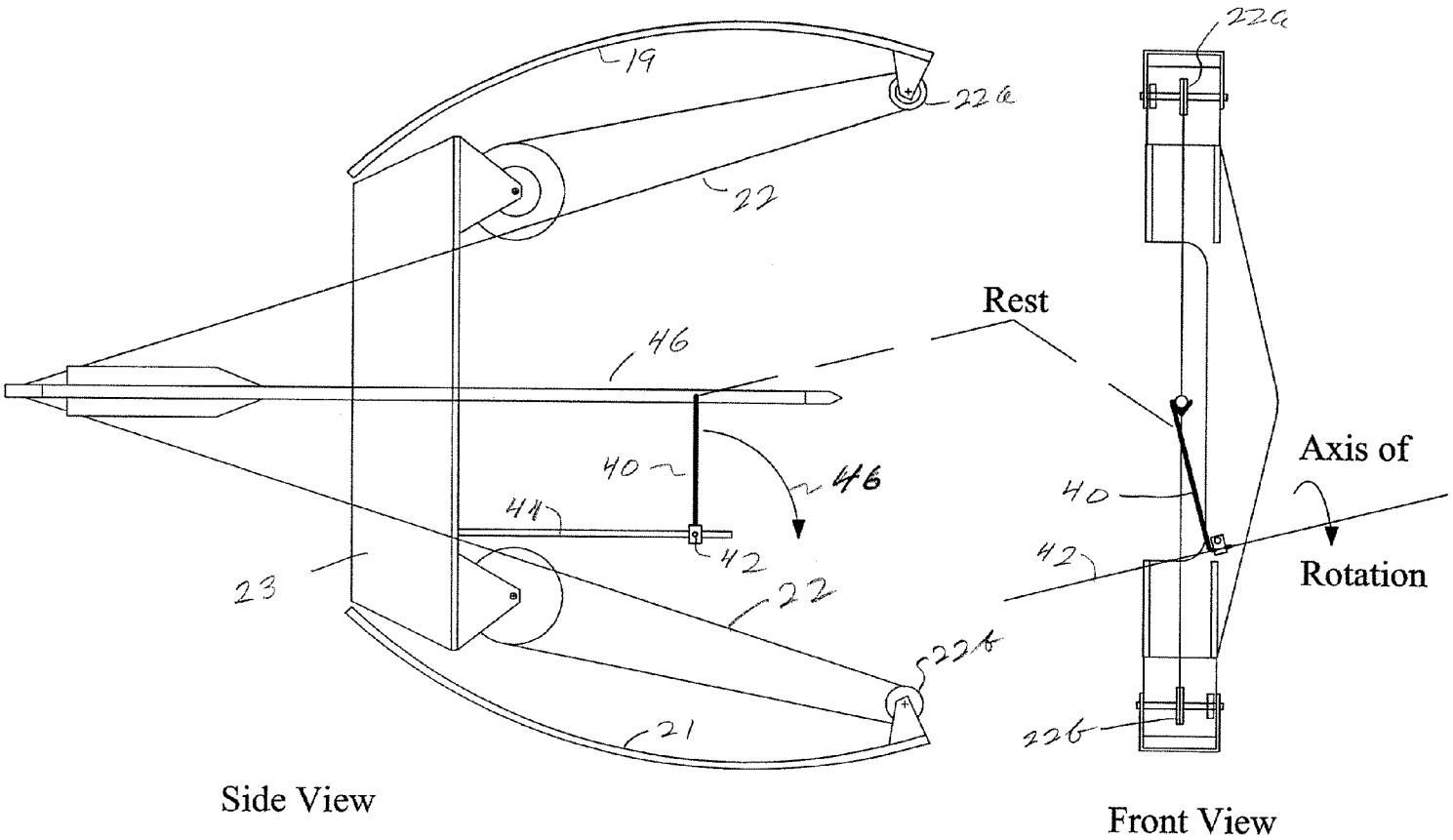
FIG. 8 shows side and front views of the arrow rest according to the disclosed embodiment.

The arrow rest 40, best shown in FIG. 8, serves to support an arrow until the arrow is accelerated by the release of the bowstring. The arrow rest 40 utilized in the disclosed embodiment is a modification of the "drop-away" type arrow rest which is widely used in the art of modern archery. In prior traditional, inverted, and compound bow designs the rest is positioned forward of the most forward excursion of the bowstring. The extreme draw-length of the present compound archery bow requires the rest to be positioned within the excursion of the bowstring between the forward and full-draw position. The arrow rest, mounted on a post 44 extending forwardly from the riser 23 and disposed below the position of an arrow 46 nocked in the bowstring, rotates on an axis 42 (FIG. 8) canted with respect to horizontal and therefore designed to rotate the arrow rest out of contact with the arrow and out of the path of the bowstring. In this embodiment, the rest 40 is held in the vertical position by a light-tension over-center spring mechanism functionally shown at 46 which releases with forward movement of the arrow. In alternative versions, the movement of the arrow rest may be mechanically coupled to the movement of the bowstring, cable 24 or 26, or a rear-slide mechanism such as described below.

Figure 9:
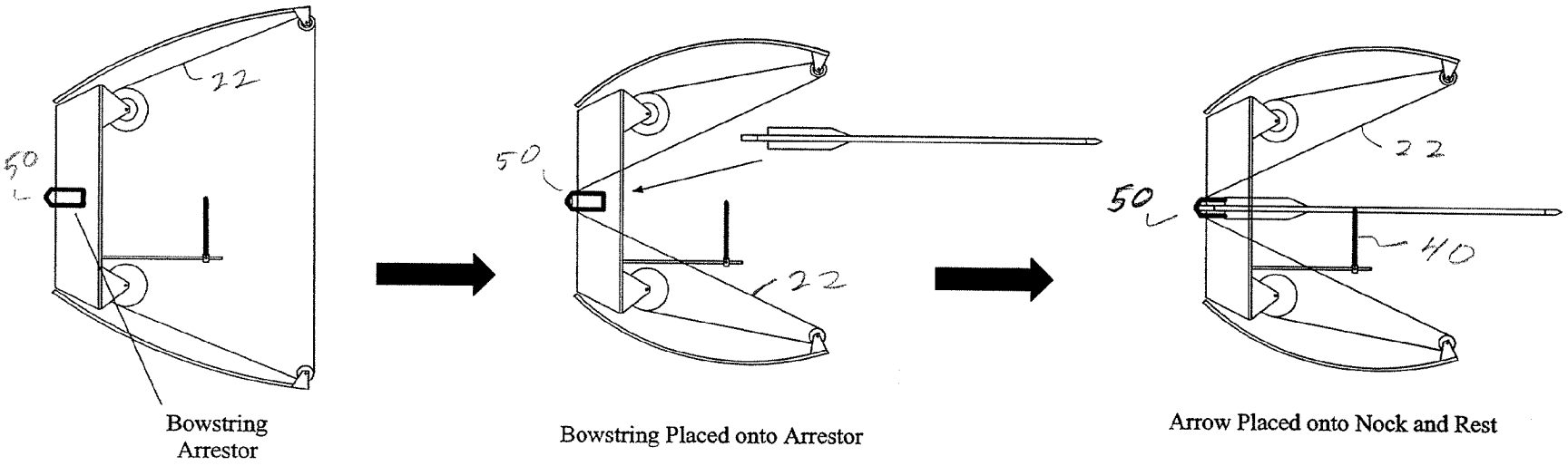
FIG. 9 illustrates the use of the bowstring arrestor according to the disclosed embodiment.
Figure 10:
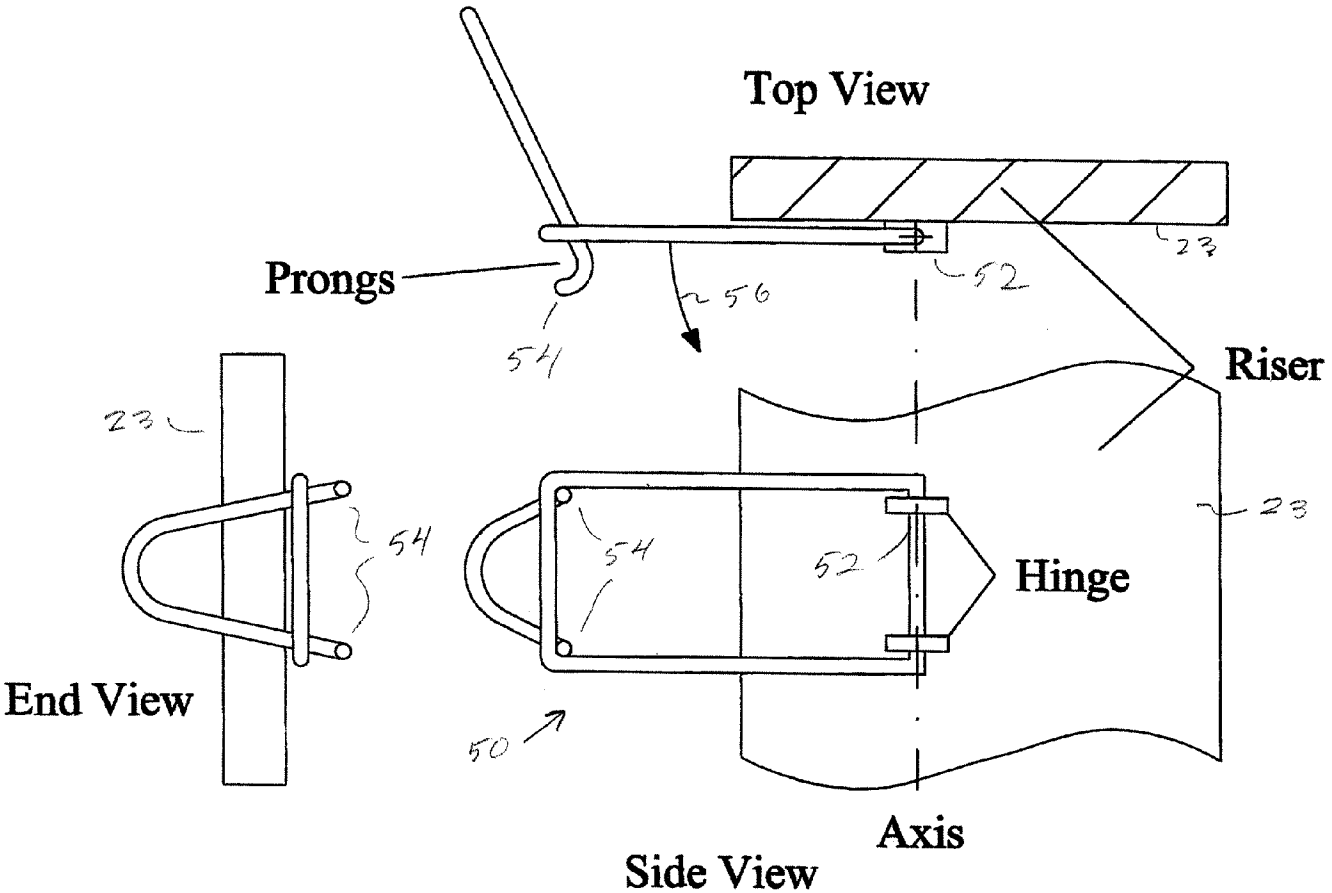
FIG. 10 shows a top view, side view, and end view of the bowstring arrestor as in FIG. 9.

The bowstring arrestor mechanism 50, FIGS. 9 and 10, functions to hold the bowstring 22 approximately midway between the forward and full-draw positions to permit placement of the arrow onto the nock and arrow rest 40 (FIG. 9). The bowstring arrestor 50 pivots outward from the riser 23, as shown by the arrow 56, on a hinge 52 to engage the bowstring on the arrestor prongs 54 (FIG. 10). As the bowstring is drawn rearward it disengages from the arrestor 50, which retracts toward the riser and out of the path of the bowstring under spring tension functionally opposite to the arrow 56.

Figure 11:
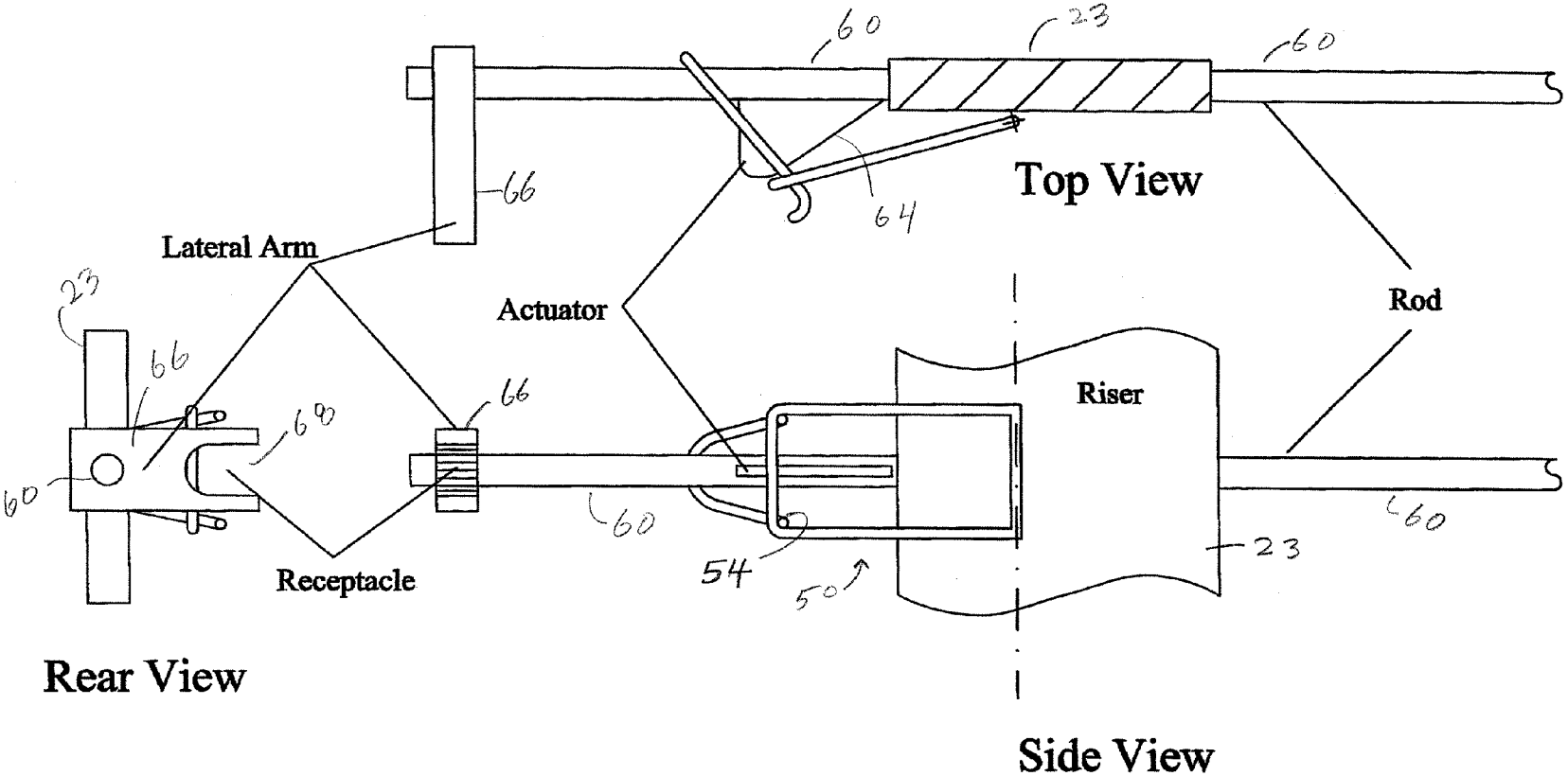
FIG. 11 shows a top view, side view, and rear view of the slide rod mechanism in the disclosed embodiment.

The slide mechanism, FIG. 11, includes a long slide rod 60 which rides fore and aft on bushings in the riser 23 on an axis laterally offset from the riser and parallel to the path of the arrow. The function of the slide is to support and stabilize the rear portion of the bow upon release of the bowstring. The slide rod 60 has an angled projection 64 extending from the slide rod facing the bowstring arrestor 50 to engage and pivot the bowstring arrestor outward from the riser 23 when the slide rod is fully forward (FIG. 11).

Figure 12:
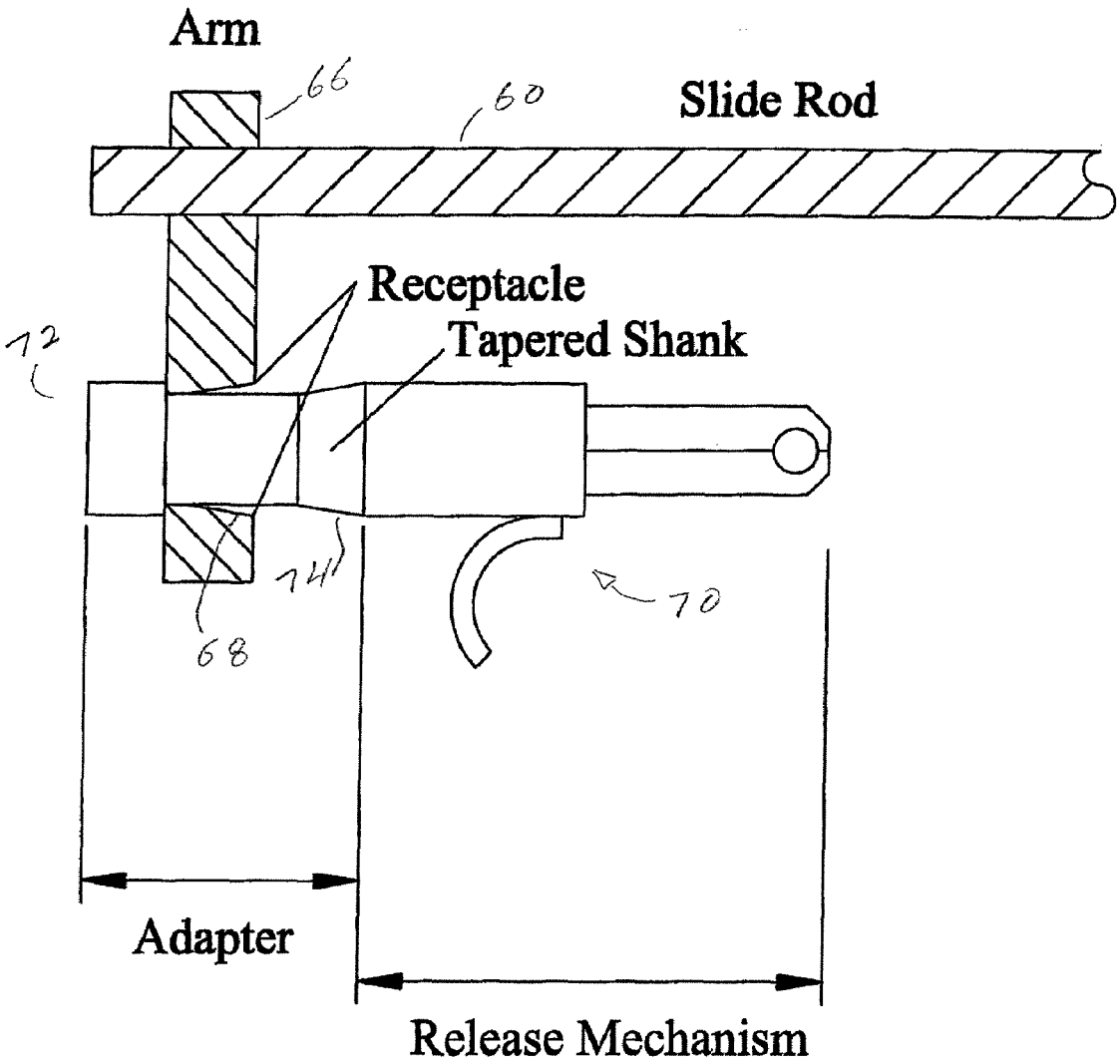
FIG. 12 illustrates the slide rod mechanism with an adapter according to the disclosed embodiment, for engaging a bowstring release mechanism.

The rear of the slide rod 60 has a short arm 66 projecting laterally from the slide rod to an outer end with a tapered receptacle 68 for receiving a release mechanism shown generally at 70. The release mechanism 70 is of a type widely used in the practice of archery and is typically used in conjunction with a wrist strap. The release mechanism and wrist strap are an accessory to the present invention and are not further described herein. A specialized adaptor 72 (FIGS. 12-14) having a shank 74 is inserted between the wrist strap and the release mechanism, and fits into the slide receptacle 68. A portion of the shank 74 of the adapter is tapered. As the release mechanism 70 is drawn rearward by an archer, the tapered shank 74 of the adapter engages the complementary taper of the tapered receptacle 68 on the slide arm 66 and prevents the adapter from unintentional disengagement (FIG. 12).

Figure 13:
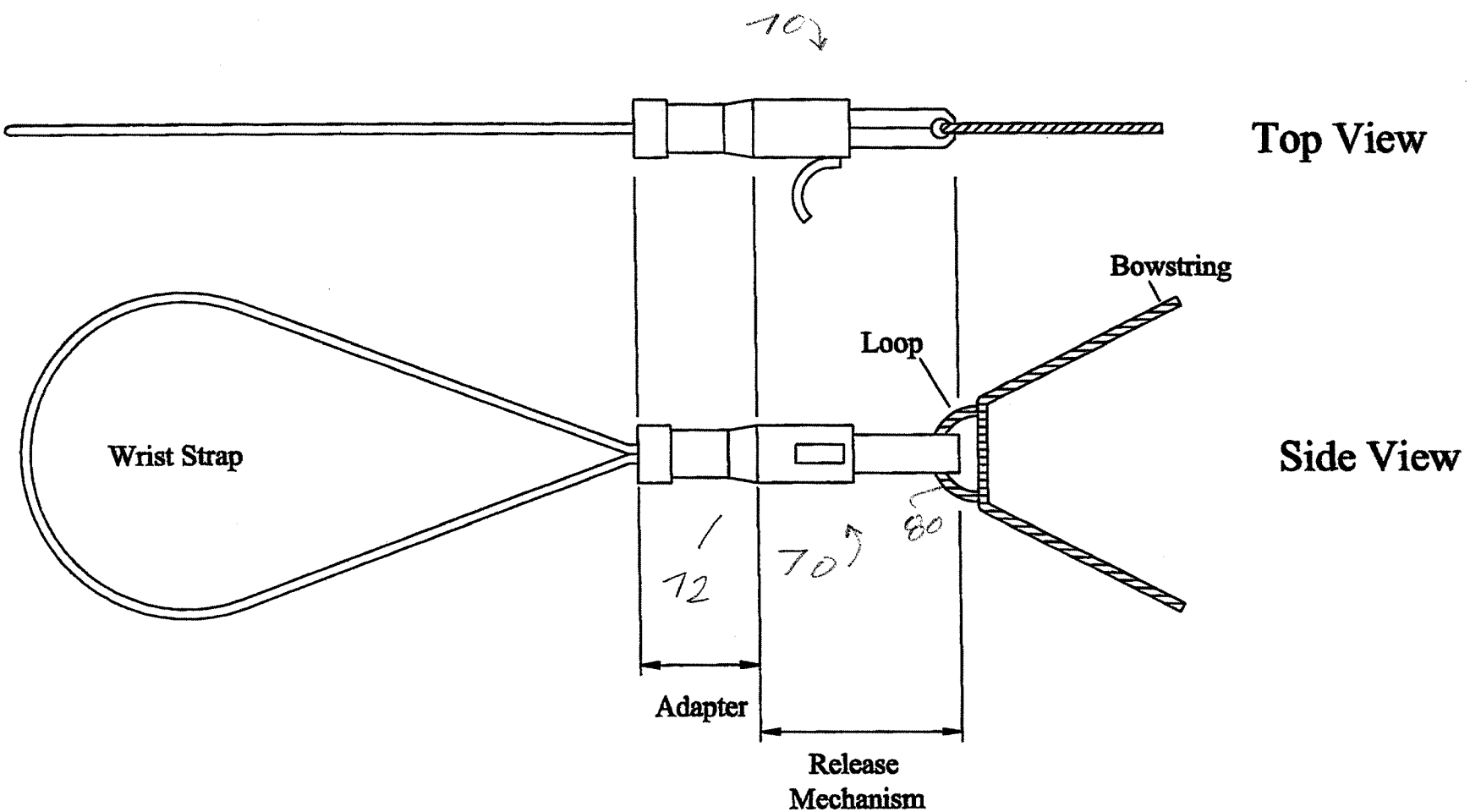
FIG. 13 shows the release mechanism with the adapter of FIG. 12.
Figure 14:
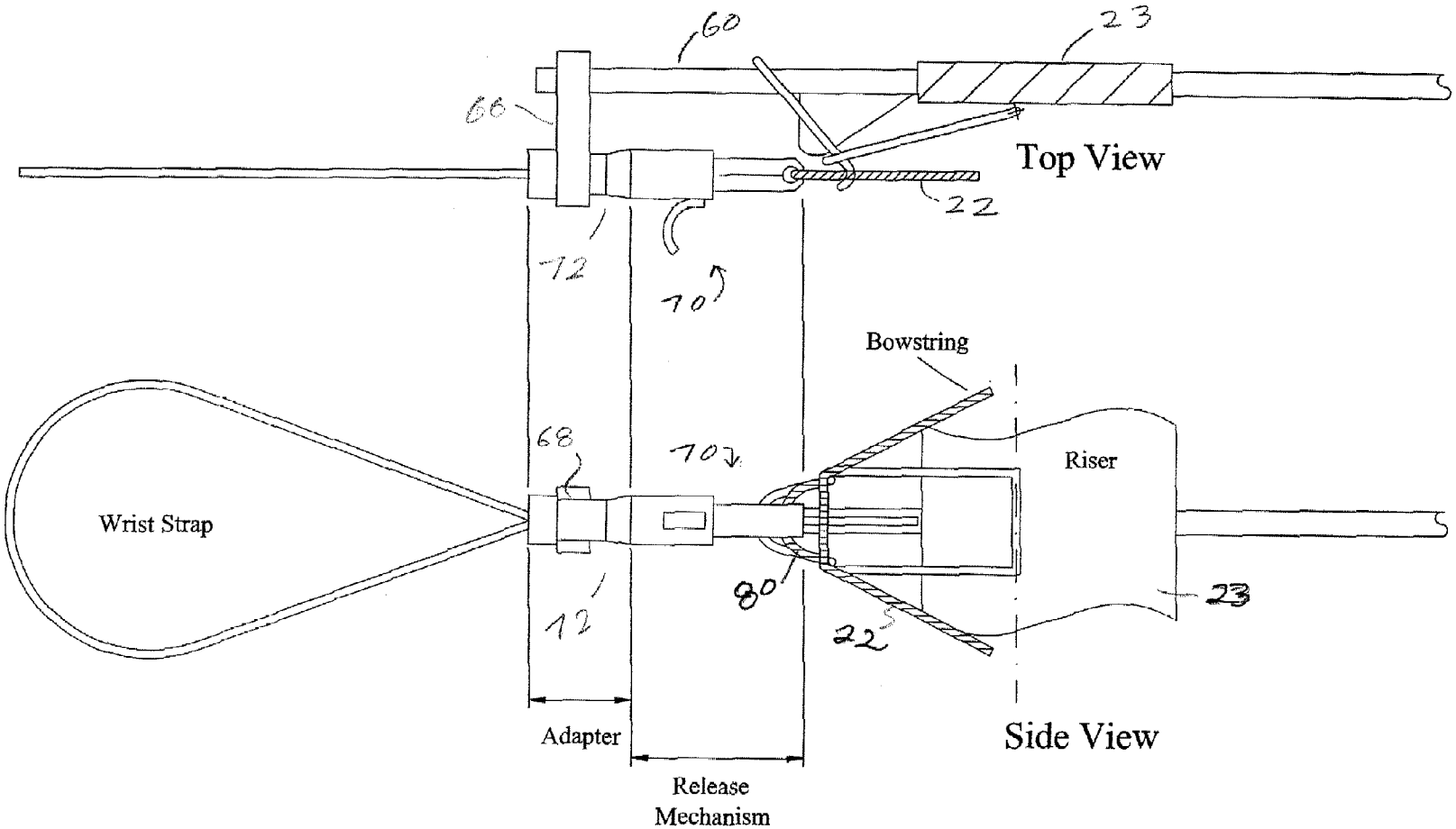
FIG. 14 shows a top view and side view of the release mechanism in the slide receptacle according to the disclosed embodiment.

Also common in the practice of archery is a short loop 80 of string attached to the bowstring 22 to aid in attachment of the release mechanism 70. FIG. 13 illustrates the bowstring adapter 72, release mechanism 70, loop 80, and bowstring 22. FIG. 14 demonstrates the release mechanism 70 engaged in the slide receptacle 68. The bowstring arrestor 70 prevents the bowstring from being released until the arrestor is disengaged by withdrawing the bowstring toward the full-draw position, FIG. 14, whereupon the arrestor retracts toward the riser 23 as previously mentioned.

The materials and construction methods used in making an archery bow according the disclosed embodiment are common in the art of archery. The limbs may be of fiberglass, carbon fiber, or other suitable strong flexible material. The riser may be of aluminum, carbon fiber, or composite material and may be forged, cast, molded, or milled. The cams and pulleys may be aluminum, plastic, or other suitable material and may be cast, molded, or machined. The bowstring is made of standard archery bowstring material. The cables may be of steel or archery bowstring material.

The steps in operation of the disclosed inverted compound archery bow are in the following sequence:

1. The forearm grip is grasped in the left hand.
2. The bowstring is drawn rearward and secured in the arrestor with the right hand.
3. The arrow rest is placed in the vertical position.
4. The arrow is placed onto the nock and rest.

5. The mechanical release is attached to the bowstring loop and the adapter is inserted into the slide receptacle.
6. The mechanical release is drawn to the full-draw position.
7. The bowstring arrestor disengages.
8. The string is released and the arrow is propelled forward.
9. The arrow rest rotates away from the arrow and out of the path of the bowstring.
10. The slide is returned to the forward position.
11. The slide actuator extends the bowstring arrestor away from the riser, and the bow is ready to fire again.

It should be understood that the foregoing relates to a preferred embodiment of the present invention, and that numerous changes and substitutions therein may be made without departing from the spirit or scope of the invention as defined in the following claims.

I claim:

1. A compound archery bow comprising:

a riser supporting a member for gripping the bow;

first and second limbs each extending in a forward direction from the riser to a distal end spaced apart from the riser;

pulley means disposed adjacent to the distal end of each limb;

a first cam and a second cam mounted with respect to the riser and rotatable on respective axes of rotation;

a bowstring extending between the pulley means on each limb so that the bowstring may be drawn on a path between a forward position and a rearward position;

one end of the bowstring extending from the pulley means on the first limb to the first cam, and another end of the bowstring extending from the pulley means on the second limb to the second cam;

a first cable extending from the first cam to the pulley means on the first limb, and thence extending to the second limb; and a second cable extending from the second cam to the pulley means on the second limb, and thence extending to the first limb, whereby drawing the bowstring toward the rearward position rotates the cams and thereby causes the cables to wind onto the cams and compress the limbs, producing limb tension that acts through the cams and pulley means to propel an arrow from the bow when the bowstring is released.

2. The compound archery bow as in claim 1, wherein:

the bowstring and the respective cables are counter wound on the respective cams so that the bowstring unwinds from the cams and winds the cables onto the cams as the bowstring is drawn, thereby placing the limbs in tension in response to drawing the bowstring.

3. The compound archery bow as in claim 1, wherein:

the first cable is attached onto the second limb; and the second cable is attached onto the first limb, so that the cables draw the respective distal ends of the limbs toward each other as the bowstring is drawn.

4. The compound archery bow as in claim 1, wherein:

each cam comprises a bowstring path from which the bowstring unwinds and thereby rotates the cam as the bowstring is drawn, and a cable path onto which the respective cable winds as the cam rotates in response to drawing the bowstring.

5. The compound archery bow as in claim 4, wherein the cable path comprises a helical path onto which the respective cable may wind for more than one revolution of the cam without overlap from successive revolutions.

6. The compound archery bow as in claim 4, wherein at least one of the bowstring path and the cable path has a radius that varies as a function of the angular position of the cam on the axis of the cam, so that the draw-force required to draw the bowstring is modified along the draw-length of the bowstring in response to the variable radius of the at least one path of each cam.

7. The compound bow as in claim 4, wherein at least one of the bowstring path and the cable path comprise a groove deep enough to accept more than one layer of the respective bowstring or cable as the cam winds for more than one revolution.

8. The compound archery bow as in claim 1, further comprising:

an arrow rest for supporting an arrow nocked to the bowstring as the bowstring is drawn and before the bowstring is released to propel the arrow; and the arrow rest being disposed between the forward position of the bowstring and a full-drawn position of the bowstring.

9. The compound archery bow as in claim 8, wherein:

the arrow rest is movable between a support position adjacent the path of the bowstring and an arrow so as to support the arrow before the bowstring is released, and a second position out of the path of the bowstring and the arrow when the bowstring is released for forward movement toward the arrow rest.

10. A compound archery bow comprising:

a riser;

limbs extending from the riser to distal ends;

a bowstring having at least a portion extending between the distal ends of the limbs so that the bowstring may be drawn along a path between a forward position at rest and a full-drawn position behind the forward position;

an arrow rest for supporting an arrow nocked to the bowstring as the bowstring is drawn and before the bowstring is released to propel the arrow, wherein the arrow rest is movable between a support position adjacent the path of the bowstring and an arrow so as to support the arrow before the bowstring is released, and a second position out of the path of the bowstring and the arrow when the bowstring is released for forward movement toward the arrow rest; and the arrow rest being disposed between the forward position and the full-drawn position of the bowstring.

11. The compound archery bow as in claim 10, further comprising:

means biasing the arrow rest to the second position in response to forward movement of the arrow, whereupon the arrow rest moves to the second position out of the path of the arrow and the bowstring.

12. The compound archery bow as in claim 10, wherein:

the arrow rest moves between the support position and the second position on an axis of rotation laterally spaced apart from the path of the bowstring and the arrow, so as not to interfere with the forward movement of the bowstring or the arrow.

13. The compound archery bow as in claim 12, further comprising:

a mounting element extending from the riser to support the arrow rest at the axis of rotation, with the axis of rotation of the arrow rest being canted with respect to the riser so that the arrow rest rotates out of contact with the arrow and out of the path of the bowstring when the bowstring is released.

14. The compound archery bow as in claim 10, further comprising:

a bowstring arrestor associated with the riser for holding the bowstring at an intermediate position between the forward position and the full-drawn position; and the bowstring arrestor being operative to disengage the bowstring and retract from the path of the bowstring in response to drawing the bowstring back from the intermediate position, so that the retracted bowstring arrestor does not interfere with forward movement of the bowstring upon release of the bowstring.

15. The compound bow as in claim 14, wherein:

the bowstring arrestor is pivotably supported in relation to the riser for movement between an operative position proximate to the bowstring path and a retracted position;

the bowstring arrestor has a holding member that enters the path of the bowstring when the bowstring arrestor is at the operative position and is engaged by the bowstring at the intermediate position; and further comprising means urging the bowstring arrestor toward the retracted position, whereby upon drawing the bowstring back from the intermediate position the bowstring moves out of engagement with the holding member, allowing the bowstring arrestor to move to the retracted position.

16. A compound archery bow comprising:

a riser;

limbs extending from the riser to distal ends;

a bowstring having at least a portion extending between the distal ends of the limbs for drawing along a path between a forward position at rest and a full-drawn position behind the forward position;

a bowstring arrestor associated with the riser for holding the bowstring at an intermediate position between the forward position and the full-drawn position; and an actuator, positioned on a slide rod of the riser, for automatically deploying the bowstring arrestor;

the bowstring arrestor being operative to disengage the bowstring and retract from the path of the bowstring in response to drawing the slide rod back from the intermediate position, so that the retracted bowstring arrestor does not interfere with forward movement of the bowstring upon release of the bowstring.

17. The archery bow as in claim 16, wherein;

the bowstring arrestor is pivotably supported in relation to the riser for movement between an operative position proximate to the bowstring path and a retracted position;

the bowstring arrestor having a holding member that enters the path of the bowstring when the bowstring arrestor is at the operative position and is engaged by the bowstring at the intermediate position; and the bowstring arrestor including a mechanism that pulls the bowstring arrestor toward the retracted position, whereby upon drawing the slide rod back from the intermediate position the bowstring moves out of engagement with the holding member, allowing the bowstring arrestor to move to the retracted position.

18. An archery bow, comprising:

a riser;

limbs extending from the riser;

a bowstring having at least a portion extending between the limbs for drawing along a path between a forward position at rest and a frill-drawn position behind the forward position;

a support member associated with the riser for selective rearward and forward movement laterally offset from the path of the bowstring;

an arm laterally extending from the support member for positioning behind the full-drawn position of the bowstring as the support member is moved rearwardly; and the arm having a receptacle to receive and provide lateral support to a release mechanism that draws the bowstring to the full-drawn position while the arm and the support member move rearwardly with the release mechanism; and an adapter engaging the release mechanism and having a tapered portion, wherein the receptacle of the arm having a taper complementary to the tapered portion of the adapter and engaging the adapter as the release mechanism draws the bowstring rearwardly, whereby the adapter maintains the release mechanism in spaced apart relation to the arm so as to prevent unintentional disengagement of the release mechanism from a slide mechanism.

* * * * *